United States Patent [19]

Kasubke et al.

[11] 4,118,130

[45] Oct. 3, 1978

[54] UNITARY ARRANGEMENT FOR COATING SKIS AND OTHER PLANAR SURFACES

[76] Inventors: Dietmar Kasubke; Wilhelm Trefz, both of Liepziger Str. 9, D-7157 Murrhardt, Fed. Rep. of Germany

[21] Appl. No.: 770,813

[22] Filed: Feb. 22, 1977

[30] Foreign Application Priority Data

Feb. 21, 1976 [DE] Fed. Rep. of Germany ..... 2607063

[51] Int. Cl.[2] ..... B05C 17/00

[52] U.S. Cl. ..... 401/2; 118/3

[58] Field of Search ..... 118/3, 202; 401/2, 1, 401/264; 222/146 H

[56] References Cited

U.S. PATENT DOCUMENTS

| | | | |
|---|---|---|---|
| 1,052,578 | 2/1913 | Fitzgerald | 401/48 X |
| 1,150,584 | 8/1915 | Englander | 401/2 |
| 1,726,832 | 9/1929 | Hollingshead | 401/2 |
| 1,848,791 | 3/1932 | Medeiros | 401/2 |
| 2,118,415 | 5/1938 | Pesark | 401/1 |
| 2,746,085 | 5/1956 | Sailors | 401/264 X |
| 3,988,070 | 10/1976 | Tobler et al. | 401/2 |

FOREIGN PATENT DOCUMENTS

| | | | |
|---|---|---|---|
| 1,379,071 | 12/1964 | France | 401/264 |

*Primary Examiner*—John P. McIntosh

[57] ABSTRACT

A unitary arrangement for quickly and effectively coating ski runners and similar planar surfaces with a heat-plasticizable, wax-type coating substance is described. An elongated container for the plasticizable substance is resiliently and telescopically arranged within an upwardly projecting hollow flange portion of a coating-application member, and a burner nozzle is removably secured to the container and is arranged to direct a flame either against the container wall or the wall of the application member, both of which are formed from a heat-conductive material such as brass. A downward manual pressure on the container serves to open a normally closed valve between the container and the member to complete a communication path between the interior of the container and a coating slot on the bottom of the application member, while the simultaneous activation of the nozzle will plasticize the coating composition in the container via heat conduction. Upon a longitudinal movement of the overall assembly on the surface to be coated, the now-plasticized coating composition is uniformly applied to such surface through the coating slot on the bottom of the application member.

10 Claims, 6 Drawing Figures

UNITARY ARRANGEMENT FOR COATING SKIS AND OTHER PLANAR SURFACES

BACKGROUND OF THE INVENTION

The invention relates to arrangements for coating ski runners and other planar surfaces with a heat-plasticizable, wax-like coating.

In one known arrangement of this type, a coating composition, generally in granular form, is poured over the ski runner or other surface to be coated, after which a heated flat iron is passed over the so-coated surface to plasticize the coating material.

Such technique is disadvantageous in that it typically produces an uneven depth of coating along the runner. Moreover, such technique is highly inefficient, since it is difficult, if not impossible, to prevent the granules of the coating substance to drop off the longitudinal edges of the runner surface prior to the plasticizing thereof by the iron.

SUMMARY OF THE INVENTION

Such disadvantages are overcome with the arrangement in accordance with the invention for coating a planar surface, such as a ski runner, with a heat-plasticizable substance. In an illustrative embodiment, a heat-conductive, substantially planar application member, which is adapted to be moved back and forth longitudinally along the runner, is provided on its bottom surface with a transverse coating slot, which communicates with the interior of a hollow central aperture of an upwardly extending flange portion of the application member.

An elongated hollow container, which is filled with the heat-plasticizable coating material, is supported above and coaxial with the upwardly-open central aperture of the flange, with a projecting lower end of the container extending telescopically into the aperture of the flange and into contact with a compression spring supported therein.

The upper end of the projecting lower portion of the coating container is made frusto-conical in shape to define a valve seat, which cooperates with the upper end of a valve stem threaded at its lower end into the application member to produce a normally closed valve element. The valve element opens upon a downward movement of the coating container toward the application surface against the restoring force of the compression spring, such open valve position serving to provide communication between the coating in the container, when plasticized, and the transverse coating groove in the bottom surface of the application member.

A nozzle-type burner is removably secured to the coating container, with the output of the nozzle being directed toward the heat-conductive outer surface of the container and/or the application member flange, so that when the nozzle is activated the heating of the conductive surface will melt the coating within the container and will permit the coating to flow onto the surface to be coated when the above-mentioned valve means are opened.

In one feature of the invention, a second fuel-bearing container secured to the rear end of the nozzle serves as a hand grip for the coating assembly, whereby when the cap of the coating container is manually pushed down, the ski runner can be quickly and easily coated by passing the application member thereover.

As an additional feature of the invention, a plurality of secondary grooves extend longitudinally rearwardly from spaced portions of the main coating groove on the bottom of the application member. With such arrangement, the movement of the application member over the surface to be coated will result in longitudinal beads of coating composition deposited on such surface, whereby a succeeding pass of the application member over such beads in the reverse direction will spread out the composition in a uniform coating.

BRIEF DESCRIPTION OF THE DRAWING

The invention is further set forth in the following detailed description taken in conjunction with the appended drawing, in which.

DETAILED DESCRIPTION

Figure 1:
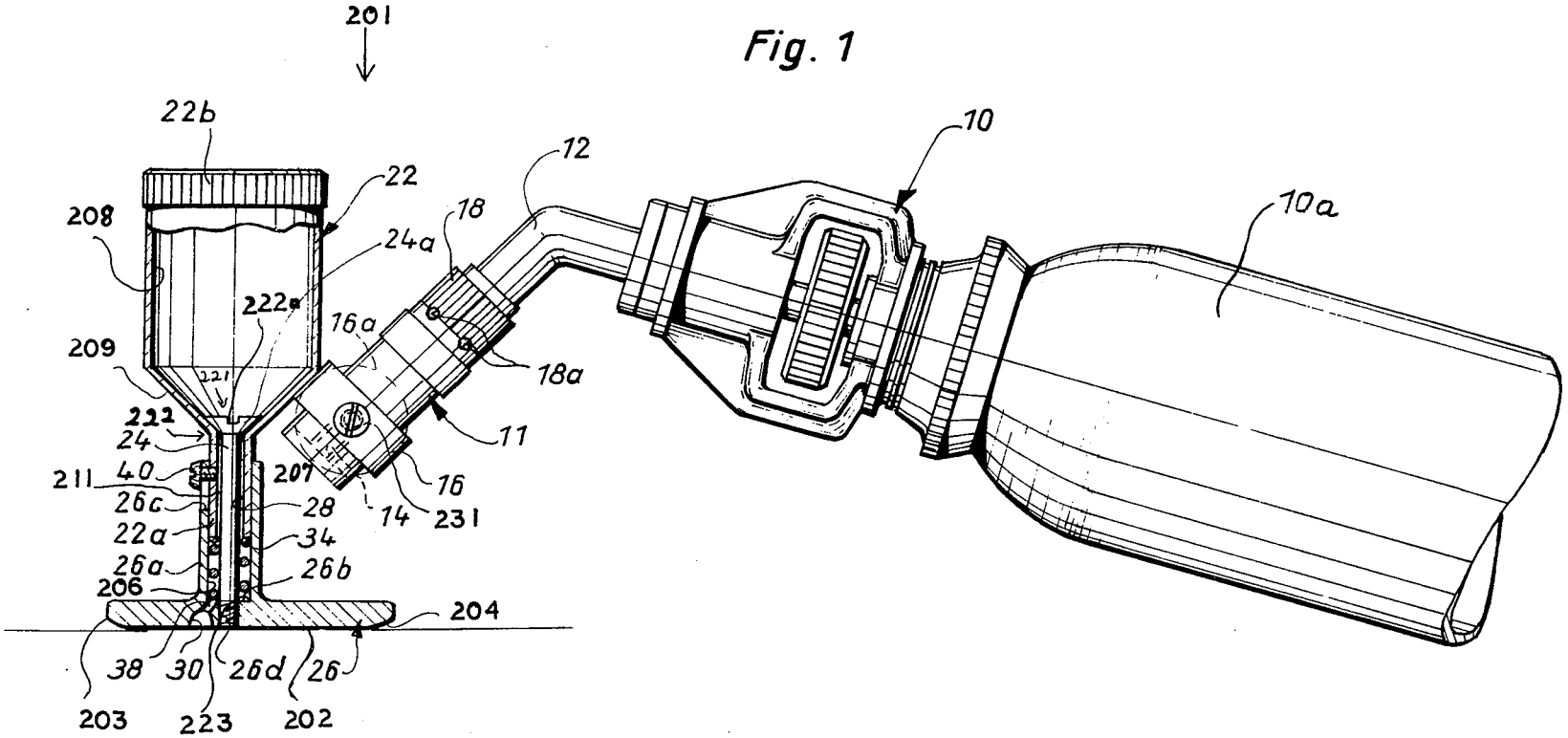
FIG. 1 is an elevation view, partially in section, of a unitary arrangement in accordance with the invention for uniformly coating a planar surface with a heat-plasticizable substance, illustrating an associated valve within such arrangement in the closed condition.
Figure 2:
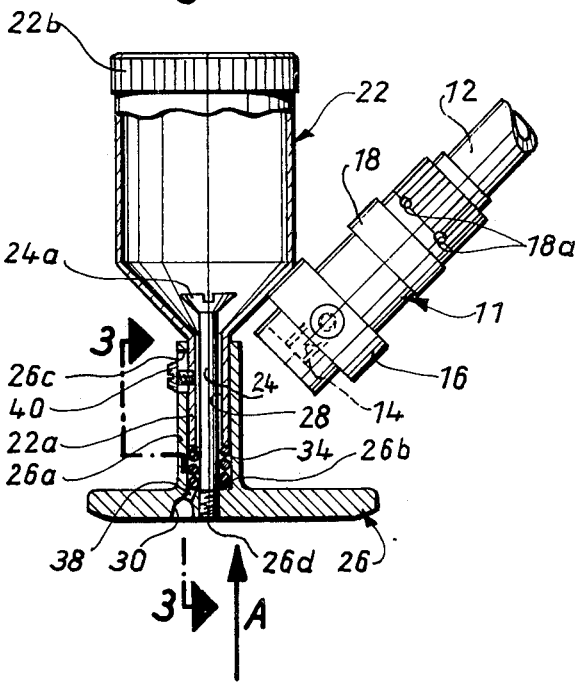
FIG. 2 is an elevation view of a portion of the arrangement of FIG. 1, illustrating the valve portion in the open condition.
Figure 3:
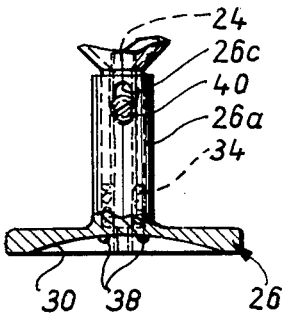
FIG. 3 is a fragmentary sectional view taken along line 3—3 of FIG. 2.

Referring now to the drawing, a unitary arrangement 201 for quickly and easily applying a uniform coating of a plasticized, wax-like substance on a ski runner or similar planar article is depicted. The arrangement 201 includes an application member 26, which is illustratively formed from brass or other material having a high thermal conductivity. The application member 26 has an elongated, substantially planar bottom surface 202, having an upwardly curved forward end 203 and a correspondingly upwardly curved rear end 204.

Figure 4:
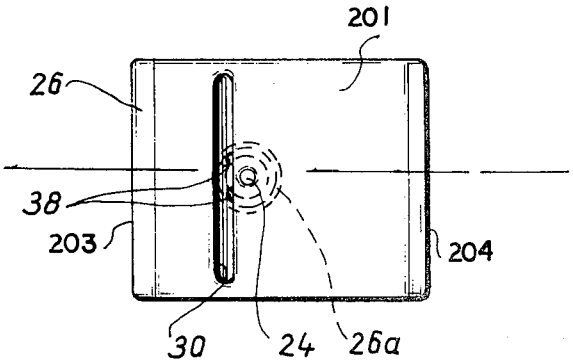
FIG. 4 is a bottom view of a portion of the arrangement of FIG. 2, illustrating the configuration of a transverse coating slot on the bottom surface of an application member of the arrangement depicted in FIG. 1.

The surface 202 is provided, intermediate its ends, with a coating recess 30, which as best illustrated in FIG. 4 is elongated in the transverse direction.

The application member 26 is further provided with a hollow flange portion **26*a*, which extends upwardly from the coating surface 202. The flange portion 26*a* includes a central aperture 206, having an open upper end 207**.

A compression spring 34 is vertically oriented in the aperture 206, with a bottom surface of the spring resting on a bottom surface **26*b*** of such aperture.

The arrangement 201 further comprises an elongated hollow container 22, which is adapted to be filled with the heat-plasticizable, wax-like substance or composition. The container 22 includes a main cylindrical portion 208, which terminates at its lower end in a downwardly and inwardly tapering frusto-conical portion 209. The lower end of the portion 209, in turn, terminates in a projecting, generally cylindrical lower portion 22*a*. The portion 22*a* has a central aperture 211, which communicates with the interior of the container 22.

As illustrated in FIG. 1, the container 22 is mounted coaxially with the application member 26, with the lower portion 22*a* of the container 22 being telescopically received within the aperture 206 of the flange portion 26*a*. The lower end of the portion 22*a* is in engagement with the upper end of the compression spring 34.

The interior of the central aperture 206 of the flange member 26*a* communicates with the elongated coating slot 30 on the bottom surface 202 of the application member 26 via an aperture 38. In order to provide a communication path between the substance in the interior of the container 22 and the coating recess 30 via the aperture 206 and the passage 38, a normally closed valve arrangement 221 is provided. The arrangement 221 includes a frusto-conical valve seat 222, defined by the lower region of the funnel-shaped container wall portion 209, and a frusto-conical upper portion 24*a* of a valve stem 24. The portion 24*a* has an upper transverse adjustment slot 222*a*. In the position shown in FIG. 1, the exterior surface of the portion 24*a* is in engagement with the valve seat 222, thereby confining the coating substance within the container 22.

The valve stem 24 extends downwardly through the central aperture 206 of the flange 26*a*, and terminates in a threaded lower end 223 that is received within an aligned threaded recess 26*d* of the coating surface 202.

With the arrangement thusfar described, a downward pressure applied to an upper closure 22*b* of the container 22 against the restoring force of the spring 34 will cause the valve seat 222 to separate from the valve portion 24*a* of the stem 24, thereby completing a communication path to the coating slot 30 for the substance in the container 22 when such substance is plasticized in the manner to be described below.

In order to confine the projecting lower portion 22*a* of the container 22 within the aperture 206, a portion 26*c* of the side wall of the aperture 206 is provided with an axially elongated radial slot, and a set screw 40 extends through the slot and into threaded engagement with a corresponding threaded bore in the side wall of the lower projecting portion 22*a*. The length of the slot 26*c* is made long enough to permit substantially a full compression of the spring 34 if desired.

A clamp 16 is secured to the upper portion of the funnel-shaped transition area 209 of the container 22. The clamp 16 cooperates with a screw 231 to removably hold a conventional burner nozzle 11, which receives fuel from a container 10*a* and air via nozzles 18*a* to generate a flame, which in turn is emitted from a front end 14 of the nozzle.

The clamp 16 is so oriented as to direct a flame from the nozzle 11 diagonally downwardly toward the flange section 22*a*. Advantageously, the container 22, like the application member 26, is formed from a highly thermally conductive material such as brass, so that a heating of the flange portion 26*a* will serve to quickly heat the wall of the container 22, since such container is intimately engaged with the flange portion 26*a* via the lower container portion 22*a* and the set screw 40. In turn, the rapid heating of the wall of the container 22 will cause a rapid plasticizing of the coating substance within the container, whereby when the valve 221 is opened such substance will flow through the coating recess 30 via (1) an annular recess 28 between the valve stem 24 and the surrounding container portion 22*a*, (2) the lower portion of the aperture 206, and (3) the passage 38.

The fuel container 10*a* is advantageously employed as a gripping handle for the coating arrangement 201. In a conventional manner, the container 10*a* communicates with an outlet portion 12 thereof through a regulating section 10, such outlet portion 12 being illustratively received within the rear end of the nozzle 11 via a threaded connection 18.

In the operation of the arrangement of FIGS. 1–4, the application surface 202 is first placed on the ski runner (not shown) or other surface to be coated, after which the regulator 10 is adjusted to admit some fuel to the nozzle 11, which is then ignited, e.g., via a match introduced thereinto through the open front end 14 thereof. The resulting flame, directed at the wall of the flange 22*a*, quickly causes plasticizing of the substance in the container 22, after which the cover 22*b* of the container 22 is pressed down against the force of the spring 34 to open the valve 221, which effects a flow of the plasticized substance to the coating slot 30. The surface 201 can now be moved continually over the runner to be coated, and a smooth and uniform coating results.

Figures 5, 6:
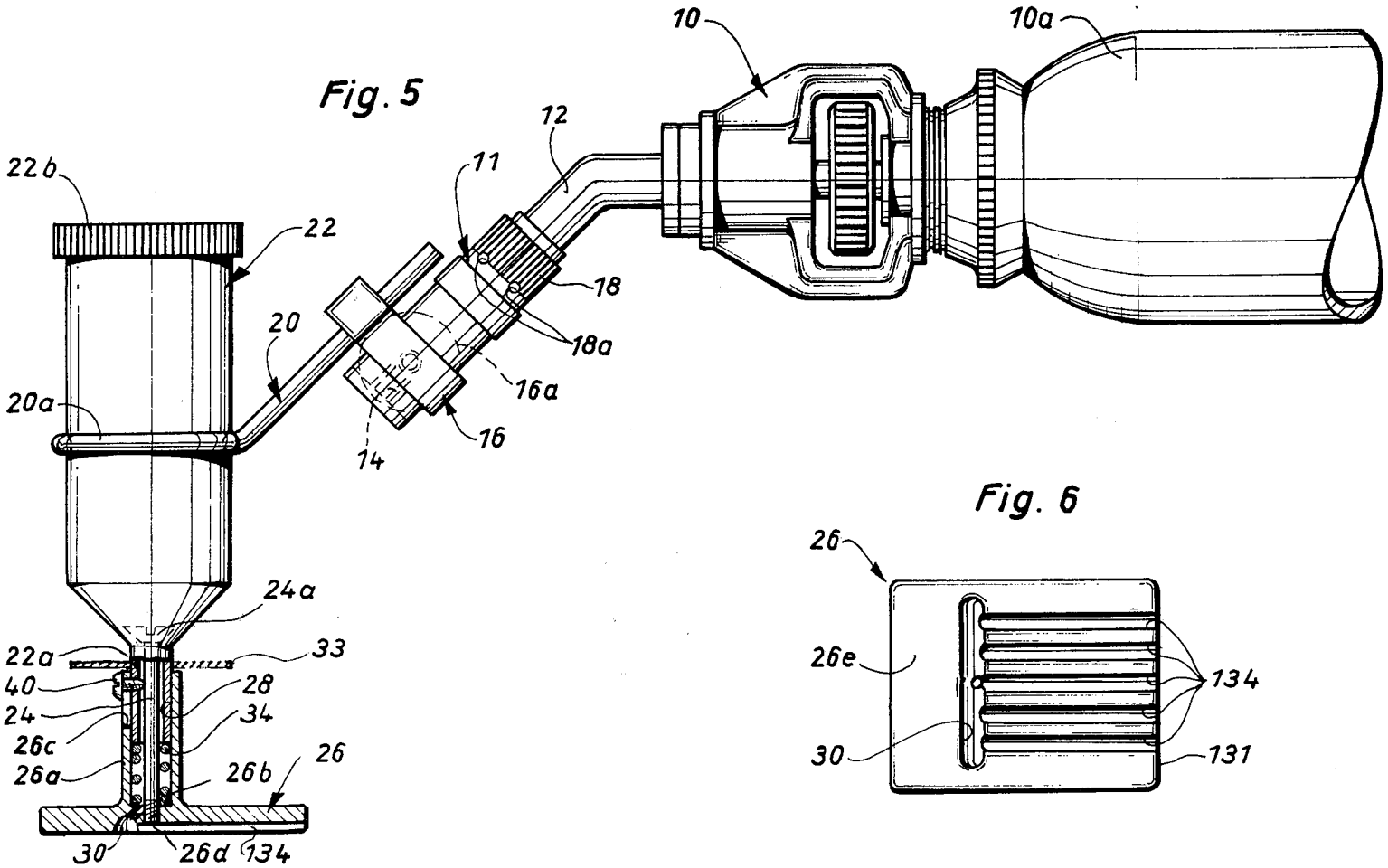
FIG. 5 is an elevation view, similar to FIG. 1, showing an alternative arrangement of mounting and directing the burner nozzle portion of the arrangement, and further illustrating a deflection plate for directing a portion of the heat from the nozzle upwardly toward a container of the arrangement for holding the coating substance.
FIG. 6 is a bottom view of a portion of the arrangement of FIG. 5, illustrating a plurality of longitudinal grooves which cooperate with the main transverse coating groove on the bottom surface of the application member.

In the modified arrangement of FIGS. 5 and 6, the clamp 16 is mounted on a carrier member 20, which in turn is secured to a support ring 20*a* around the container 22. The nozzle 11 in this case is directed downwardly and obliquely toward the side of the container 22 itself, rather than at the side of the flange portion 26*a* as in FIGS. 1–4.

A deflecting plate 33 is secured around the upper portion of the projecting lower end 22*a* of the container 22. The plate 33, which like the container 22 and the application member 26 is formed from a highly heat-conductive material, serves to deflect the flame from the burner 11 upwardly toward the walls of the container 22, thereby enhancing the heating effect thereon and more quickly plasticizing the substance therein. In addition, the plate 33 protects the interior of the flange member 26*a*, particularly the spring 34, from possible damage due to excessive heat.

In addition, and as shown best in FIG. 6, a plurality of auxiliary coating recesses 134 are disposed in parallel, transversely spaced relation on the bottom coating surface 202 of the application member 26. The slots 134, which are axially coextensive, extend rearwardly in the longitudinal direction of the coating surface 202, and terminate in their forward ends at transversely spaced portions of the main transverse coating slot 30.

The operation of the arrangement of FIGS. 5–6 is similar to that of FIGS. 1–4. After the nozzle 11 is ignited and the valve 221 opened, the plasticized substance from the container 22, after reaching the main transverse slot 30, flows into the several longitudinal slots 134, so that upon the movement of the surface 201 in the forward direction, a trailing set of longitudinal beads of the plasticized substance are laid down on the workpiece surface. Thereafter, the arrangement is reversed, and as a front surface 26*e* (FIG. 6) moves over the previously laid-down longitudinal beads on the workpiece surface, the material in the beads is flattened and deformed into a continuous uniform film. Advantageously, the transverse spacing between successive ones of the auxiliary coating slots 134 is equal to the width of each of such slots. In addition, the depth of each of the slots 134 is advantageously less than the depth of the main coating slot 30.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. A portable arrangement for coating skis with a heat-plasticizable substance, the arrangement comprising, in combination, application means including a container made out of heat-conductive material for storing the heat-plasticizable material, and a plasticizing member having an application plate with a substantially planar surface disposed underneath said plate, a conduit extending upwardly from said planar surface and said plate to said container, said planar surface having a first aperture in communication with said conduit and said plate, said conduit being made of heat-conducting material and being adapted to conduct heat-plasticizable material from said container to said first aperture; normally closed valve means operatively mounted in said conduit; and heating means operatively mounted on said container and having an outlet nozzle substantially directed toward said conduit and said plate for directing a flame to selectively plasticize said plasticizable material said plate extending laterally from said aperture and said planar surface of said plate being adapted to be passed over the underside of a ski, the improvement comprising, that said plate and conduit forms a manual applicating and coating means which is adapted to be heated by said heating means to a temperature which is higher than the temperature to which said container is heated.

2. An arrangement as defined in claim 1, in which the longitudinal ends of said planar surface of the applicating means are upwardly curved.

3. An arrangement as defined in claim 1, in which the heating means further comprises an elongated second hollow container for receiving a charge of fuel, the front end of the second container being removably secured to and in liquid communication with the rear end of the nozzle.

4. An arrangement as defined in claim 1, in which the planar surface of the application means further has at least one first transverse and one second elongated coating recess in communication with the first recess and extending perpendicularly therefrom.

5. An arrangement as defined in claim 4, in which the planar surface of the application means has a plurality of the second recesses disposed therein in coextensive relation, the second recesses respectively extending in parallel, transversely spaced relation from spaced points of the first recess.

6. An arrangement as defined in claim 5, in which the depth of each second recess is less than the depth of the first recess.

7. An arrangement as defined in claim 1, in which said conduit includes elongated biasing means vertically situated within said conduit, said container having a projecting lower portion which extends into the open upper end of said conduit to contact the upper end of the biasing means, whereby the container may be urged telescopically downwardly within the conduit toward said planar surface upon the application of a downward pressure to the container.

8. An arrangement as defined in claim 7, said normally closed valve means is associated with the container and with the application means, the valve means being arranged to be moved into an open position upon a downward movement of the container to provide communication between the interior of the container and the conduit.

9. An arrangement as defined in claim 8, in which the valve means comprises, in combination, a frusto-conical region defining a valve seat on the upper end of the projecting lower portion of the container, and an elongated valve stem having an upper end cooperating with the valve seat, the valve stem further having a lower end extending through the conduit and affixed to the application means.

10. An arrangement as defined in claim 9, in which the upper end of the valve stem comprises a frusto-conical head having an external surface complementary to the valve seat, the head normally being in engagement with the valve seat, a downward pressure on the first container being effective to move the seat away from the head to open the valve means.

* * * * *